US008318003B2

(12) United States Patent
Knottenbelt et al.

(10) Patent No.: US 8,318,003 B2
(45) Date of Patent: Nov. 27, 2012

(54) PROCESS FOR CATALYTIC CONVERSION OF FISCHER-TROPSCH DERIVED OLEFINS TO DISTILLATES

(75) Inventors: Cyril David Knottenbelt, Mossel Bay (ZA); Carl Dunlop, Cape Town (ZA); Kholekile Zono, Mossel Bay (ZA); Maxwell Thomas, Mossel Bay (ZA)

(73) Assignee: The Petroleum Oil and Gas Corporation of South Africa (Pty) Ltd., Mossel Bay (ZA)

( * ) Notice: Subject to any disclaimer, the term of this patent is extended or adjusted under 35 U.S.C. 154(b) by 472 days.

(21) Appl. No.: 12/537,178

(22) Filed: Aug. 6, 2009

(65) Prior Publication Data

US 2009/0294329 A1 Dec. 3, 2009

Related U.S. Application Data

(63) Continuation of application No. 11/722,170, filed as application No. PCT/ZA2005/000184 on Dec. 20, 2005, now abandoned.

(60) Provisional application No. 60/653,555, filed on Feb. 16, 2005.

(30) Foreign Application Priority Data

| | | |
|---|---|---|
| Dec. 23, 2004 | (ZA) | 2004/10360 |
| Feb. 16, 2005 | (ZA) | 2005/1372 |
| Feb. 16, 2005 | (ZA) | 2005/1373 |

(51) Int. Cl.
*C10G 45/00* (2006.01)

(52) U.S. Cl. ..... 208/49; 208/57; 208/62; 208/66; 585/520; 585/530; 585/532; 585/533

(58) Field of Classification Search ..... 208/49, 208/57–66; 17/49, 57–66
See application file for complete search history.

(56) References Cited

U.S. PATENT DOCUMENTS

| | | | | |
|---|---|---|---|---|
| 2,779,713 | A | 1/1957 | Cole et al. | |
| 3,767,562 | A | 10/1973 | Sze et al. | |
| 3,788,971 | A | 1/1974 | Kirk et al. | |
| 4,125,566 | A | 11/1978 | Trin Dinh et al. | |
| 4,157,294 | A * | 6/1979 | Iwao et al. | 208/264 |
| 4,544,792 | A * | 10/1985 | Smith et al. | 585/533 |
| 4,902,847 | A | 2/1990 | Juguin et al. | |
| 5,368,722 | A * | 11/1994 | Bartholdy | 208/149 |
| 5,391,291 | A * | 2/1995 | Winquist et al. | 208/143 |
| 5,847,252 | A | 12/1998 | Stine et al. | |
| 6,875,339 | B2 * | 4/2005 | Rangarajan et al. | 208/62 |
| 2003/0150776 | A1 | 8/2003 | Johnson et al. | |
| 2003/0171632 | A1 | 9/2003 | Du Toit et al. | |
| 2003/0199718 | A1 | 10/2003 | Miller | |

* cited by examiner

*Primary Examiner* — Brian McCaig
(74) *Attorney, Agent, or Firm* — Knobbe Martens Olson & Bear LLP

(57) ABSTRACT

The invention provides a low aromatic producing process for catalytical conversion of Fisher-Tropsch derived olefins to distillates (COD), which process includes the step of contacting Fisher-Tropsch derived olefins with a zeolite type catalyst at pressures of more than 50 barg.

9 Claims, No Drawings

PROCESS FOR CATALYTIC CONVERSION OF FISCHER-TROPSCH DERIVED OLEFINS TO DISTILLATES

CROSS-REFERENCE TO RELATED APPLICATIONS

This application is a continuation of U.S. patent application Ser. No. 11/722,170 filed filed Jan. 9, 2008, which is the national phase under 35 U.S.C. §371 of prior PCT International Application No. PCT/ZA2005/000184 which has an International filing date of Dec. 20, 2005, which designates the United States of America and which claims priority to U.S. Provisional Appl. No. 60/653,555 filed Feb. 16, 2005, South Africa Appl. No. 2004/10360 filed Dec. 23, 2004, South Africa Appl. No. 2005/1373 filed Feb. 16, 2005, and South Africa Appl. No. 2005/1372 filed Feb. 16, 2005, the disclosures of each of which are hereby incorporated by reference in their entireties.

Field of the invention

This invention relates to a process for producing synthetically derived distillates.

BACKGROUND OF THE INVENTION

It is well known that aromatics in products such as diesel, gasoline and kerosene is carcinogenic and normally have a negative effect on the characteristics of such products.

Normally catalytical conversion of Fisher-Tropsch derived olefins with shape selective zeolites to distillates (COD) produce distillates having more than about 10% aromatics. The Fisher-Tropsch process referred to is known as High Temperature Fisher-Tropsch, which produces generally short chain $C_2$ to $C_4$ olefins.

It is an object of this invention to provide a COD process wherein distillates are produced with a low aromatic content, which in turn will allow diesel, gasoline and kerosene with low aromatic content to be produced.

SUMMARY OF THE INVENTION

According to the invention, there is provided a process for catalytical conversion of Fisher-Tropsch derived olefins to distillates (COD), which process includes the step of:

contacting Fisher-Tropsch derived olefins with a zeolite type catalyst at pressures of more than 50 barg.

The catalyst may be a MFI-type zeolite catalyst as defined by the International Zeolite Association (IZA).

The reactor temperature may be maintained below 280° C.

The Fisher-Tropsch derived olefins are converted to distillates over a shape selective zeolite catalyst. The conversion includes oligomerising and isomerising of the Fisher-Tropsch derived olefins to produce an intermediate olefinic COD product.

The process may include the step of hydrotreating the intermediate COD product.

The hydrotreating step may include two steps, first distillate hydrotreating of the COD product followed by an optional second deep hydrotreating step to remove practically all aromatics. Hydrotreated fractions may be collected during the distillate hydrotreating step before the deep hydrotreating step.

Alternatively, the hydrotreating step may comprise a one step deep hydrotreating step of the COD product followed by collecting of hydrotreated fractions.

It will be appreciated that a one step reaction requires a lower capitol and running costs, while the two step reaction enables better heat management.

The one step deep hydrotreating process may include hydrogenation over a Group 10 metal catalyst.

The Group 10 metal catalyst may include a high nickel content.

Alternatively, the Group 10 catalyst may include a noble metal such as supported platinum catalysts. These catalysts may also be bimetallic.

The catalyst may be Nickel supported on alumina or platinum supported on alumina. (Sud Chemie G134 or Axens LD 402).

The one step deep hydrotreating step may include hydrogenation over a high nickel content hydrotreating catalyst or hydrotreating with a nobel metal catalyst. Reactor pressures for such reactions would typically range from 5000 kPa to about 8000 kPa but not excluding higher pressures. Reaction temperatures vary from about 200° C. to 260° C. while the LHSV range from 0.3 to 2 depending on the feed.

In the two step hydrotreating step, the intermediate olefinic product is hydrogenated over a nickel-molybdenum catalyst (Axens HR348 for such Sulphur and Nitrogen free feeds) or over cobalt-molybdenum catalysts. The support may be $Al_2O_3$ or $SiO_2/Al_2O_3$. The reaction temperature ranges from about 240 to below 350° C. at pressures of between 5000 to 8000 kPa. The hydrogen to hydrocarbon ratio is maintained at about 400 $nm^3$/hr at LHSV of between 0.3 and 1.

The support for the metal may be neutral. The applicant is aware that an acidic support causes unwanted cracking during hydrogenation.

The olefin content measured as Bromine Number determines the reactivity of a particular feed, highly reactive feeds may require a portion of the hydrogenated product to be recycled to quench the hydrogenation reaction of the hydrotreating step. The LHSV may also be altered to below 0.5 to control excessive exothermic reactions.

The hydrotreatment catalyst may be loaded into the reactor bed in an increased graded approach to limit an excessive exothermic reaction developing at the top of the reactor. The catalyst bed may have multiple zones with increased grades. Typically, a 4-zone graded catalyst bed. The concentration of the active catalyst in each of the 4 zones may be diluted with an inert ceramic in the following typical ratios of catalyst to ceramics, 0.2; 0.5; 170.0 and 650.

The catalytic conversion at pressures of more than 50 barg and/ or a reactor temperature maintained below 280° C. produces a product stream with low aromatics and it will be appreciated that the relative low aromatics from the COD step allows moderate hydrogenation reactor conditions, limiting unwanted side reactions.

The process may include the step of blending the intermediate COD product or the hydrotreated fraction with alcohols to reduce particulate matter emissions from fuels derived from intermediate COD product or the hydrotreated fraction. The alcohols may range from 1 to 5 carbon alcohols, preferably 2 to 5 carbon alcohols.

DETAILED DESCRIPTION OF THE PREFERRED EMBODIMENT

The invention is now described by way of example.

Example 1

Light olefins in the carbon range C3 to C6 originating from a High Temperature Fischer Tropsch plant located in Mossel Bay were oligomerised over a proprietary zeolite catalyst (COD 9) as supplied by Sud Chemie. The oligomerisation reaction was performed at moderate temperatures below 280° C. and relatively high pressures of 55-bar process for the oligomerisation reaction to produce an olefinic distillate with a Bromine Number of over 90 g Br/100 g sample. The olefinic portion of the sample was hydrotreated at moderate hydrotreating conditions in Diesel Hydrotreater unit equipped with a cobalt molybdenum (Engelhard E 5256) catalyst, at 58 kPa, the WABT did not exceed 321° C., the LHSV was maintained at 0.6 while the Hydrogen to Hydrocarbon Ratio was 275. The analyses indicated lower aromatic content distillate and resultant diesel fraction as can be seen below in Table 1. It should be noted that only olefins were hydrogenated and not aromatics, which can be hydrogenated in a second hydrogenation step. The High Aromatic analysis is given for comparative purposes, where the oligomerisation reaction is run under normal conditions. If required, the 5.8% aromatic content of the intermediate product can be significantly lowered with a second hydrotreating step, using a nickel-molybdenum catalyst and similar hydrotreating conditions than for the first step. Preferably, the WABT of the second step should be lower than that of the first step.

TABLE 1

| Hydrocarbon Type | Z Number | % Low Aromatic | % High aromatic |
|---|---|---|---|
| Paraffins | $C_nH_{2n}$ | 14.0 | 12.3 |
| Monocycloparaffins Olefin | $C_nH_{2n}$ | 58.3 | 50.4 |
| Dicycloparaffins Monocycloparaffin + olefin | $C_nH_{2n-2}$ | 19.1 | 17.2 |
| Tricycloparaffins Dicycloparaffins + olefin | $C_nH_{2n-4}$ | 2.8 | 9.1 |
| Tetracycloparaffins Triclycloparaffin + olefin | $C_nH_{2n-6}$ | 0.0 | 0.6 |
| Total | | 94.2 | 89.6 |
| Alkyl Benzenes | $C_nH_{2n-6}$ | 4.8 | 7.3 |
| Bezocycloparaffins | $C_nH_{2n-8}$ | 1.0 | 3.1 |

TABLE 1-continued

| Hydrocarbon Type | Z Number | % Low Aromatic | % High aromatic |
|---|---|---|---|
| Benzodicycloparaffins | $C_nH_{2n-10}$ | 0.0 | 0.0 |
| Naphthalenes | $C_nH_{2n-12}$ | 0.0 | 0.0 |
| Acenaphalenes/Biphenyls | $C_nH_{2n-14}$ | 0.0 | 0.0 |
| Fluorenes | $C_nH_{2n-16}$ | 0.0 | 0.0 |
| Phenanthrenes/Anthracenes | $C_nH_{2n-18}$ | 0.0 | 0.0 |
| Total Aromatics | | 5.8 | 10.4 |

Example 2

Light olefins in the carbon range $C_3$ to $C_6$ originating from a the High Temperature Fischer Tropsch plant located in Mossel Bay were oligomerised over a proprietary zeolite catalyst (COD 9) as supplied by Sud Chemie. The oligomerisation reaction was performed at moderate temperatures below 280° C. and relatively high pressures of 55 bar process were used for the oligomerisation reaction to produce an olefinic distillate with a Bromine Number of over 90 g Br/100 g sample. This distillate was hydrotreated in one step using a high Nickel content commercial catalyst as supplied by Sud Chemie. (Sud Chemie G134) The catalysts (about 270 cc) were loaded into a pilot plant reactor in a graded bed format and diluted with inert ceramics in the ratios of catalyst to ceramics of, 0.2; 0.5; 170.0 and 650. The reactor pressure was maintained at 58 bar, the WABT did not exceed 220° C., the LHSV was maintained at 0.9 and a third of the product was recycled back to the feed. The one step hydrotreated distillate was fractioned by means of a true boiling point distillation apparatus to yield a diesel fraction in the boiling range 220° C. to 340° C. This fuel was found to contain less than 0.1% v/v aromatics and no detectable polyaromatic hydrocarbons. The fuel typical quality is depicted below:

| PROPERTY | MEASURE UNIT | TEST METHOD | TYPICAL ANALYSIS |
|---|---|---|---|
| Colour | ASTM | ASTM D156 | +30 |
| Density @ 20° C. | kg/l | ASTM D1298 | 0.796 |
| Aromatic Content | % (m/m) | IP391 | <1 |
| Distillation: | | ASTM D86 | |
| 90% (v/v) Recovery | ° C. | | 320 |
| FBP | ° C. | | 340 |
| Flash Point (P.M.cc.) | ° C. | ASTM D93 | 93 |
| Kinematic Viscosity @ 40° C. | CSt | ASTM D445 | 2.7 |
| Cold Filter Plugging Point | ° C. | IP309 | < minus 45 |
| Ash Content | % (m/m) | ASTM D482 | <0.01 |
| Sediment by Extraction | % (m/m) | ASTM D473 | <0.01 |
| Water Content | % (v/v) | ASTM D1744 (Mod) | <0.01 |
| Carbon Residue, Ramsbottom (on 10% residue) | % (m/m) | ASTM D524 | 0.15 |
| Total Sulphur | % (m/m) | ASTM D2622 or ASTM D5453 | 0.0004 |
| Copper Corrosion (3 hrs @ 100° C.) | Rating | ASTM D130 | |
| Cetane Number | — | ASTM D613 - IP41 | 54 |
| Oxidation Stability | mg/100 ml | ASTM D2274 | <0.1 |

The above fuel combined with it's low aromatics content, favourable emission qualities and excellent cold flow properties make it an excellent fuel for use in polluted cities (City Diesel) especially those with cold climates.

Example 3

Light olefins in the carbon range C3 to C6 originating from a the High Temperature Fischer Tropsch plant located in Mossel Bay were oligomerised over a proprietary zeolite catalyst (COD 9) as supplied by Sud Chemie. The oligomerisation reaction took place at moderate temperatures below 280° C. and relatively high pressures of 55 bar process were used for the oligomerisation reaction to produce an olefinic distillate with a Bromine Number of over 120 g Br/100 g sample. This distillate was hydrotreated in one step using a supported Platinum commercial catalyst (Axens LD402). The catalyst (270 cc) was loaded into a pilot plant a graded bed format and diluted with inert ceramics. The reactor pressure was maintained at 60 bar, the WABT did not exceed 230° C., the LHSV was maintained at 0.9 and a portion of the product was recycled. The one step hydrotreated distillate was fractioned by means of a true boiling point distillation apparatus to yield a diesel fraction in the boiling range 220° C. to 340° C. This fuel was found to contain less than 0.1% v/v aromatics. Emission testing performed on a similar fuel made from the process was found to offer substantial vehicle regulated reductions over commercial low sulphur diesel fuels. Reductions were noted for all regulated emissions, these included hydrocarbons, carbon monoxide, carbon dioxide, nitrous oxides and particulate matter. The fuel was dosed with a commercial lubricity additive (OLI 5000) as supplied by Ethyl at a dose rate of 150 ppm v/v. This was found to be an ideal additive for sulphur free synthetically derived fuels as produce by the above process. The absence of sulphur from these fuels enabler modern vehicle exhaust aftertreatment technologies. In cases were these fuels are used in a bus equipped with a catalytic device the exhaust emissions were further reduced. The fuel typical quality is depicted below: PIONA composition as tested by GC-FIMS:

| | |
|---|---|
| Parafins-Iso | 65.3% mass |
| Parafins- n | 2.7% mass |
| Monocycloparaffin's | 24.3% mass |
| Dicycloparaffin's | 7.6% mass |
| Aromatics | <0.1% mass |

The % branching of iso-paraffins;

methyl 60 to 70;
ethyl 2 to 10;
propyl 0.2 to 5;
butyl 0.1 to 5;
hexyl 0.1 to 2.

The NMR branching index is 0.165, 0 indicating absence of branching and 1 indicating full branching.

It shall be understood that the examples are provided for illustrating the invention further and to assist a person skilled in the art with understanding the invention and are not meant to be construed as unduly limiting the reasonable scope of the invention.

The invention claimed is:

1. A process for catalytic conversion of Fisher-Tropsch derived olefins to distillates, comprising the steps of:

contacting Fisher-Tropsch derived olefins with a ZSM-5 catalyst at a pressure of more than 50 barg and at a reactor temperature maintained below 280° C. to produce a COD product;

hydrotreating the COD product using a cobalt-molybdenum catalyst to obtain a first hydrotreated fraction; and hydrotreating the first hydrotreated fraction using a nickel-molybdenum catalyst to obtain a second hydrotreated fraction.

2. The process of claim 1, wherein the weighted average bed temperature for hydrotreating the first hydrotreated fraction is lower than the weighted average bed temperature for hydrotreating the COD product.

3. The process of claim 1, wherein hydrotreating the first hydrotreated fraction removes practically all aromatics.

4. The process of claim 1, wherein the nickel-molybdenum catalyst is supported by an $Al_2O_3$ or $SiO_2/Al_2O_3$ support.

5. The process of claim 1, wherein the nickel-molybdenum catalyst is supported by an $SiO_2/Al_2O_3$ support.

6. The process of claim 1, wherein the cobalt-molybdenum catalyst is supported by an $Al_2O_3$ or $SiO_2/Al_2O_3$ support.

7. The process of claim 1, wherein the cobalt-molybdenum catalyst is supported by an $SiO_2/Al_2O_3$ support.

8. The process of claim 1, wherein hydrotreating the first hydrotreated fraction using a nickel-molybdenum catalyst is conducted at a temperature of from 240° C. to below 350° C. and at a pressure of from 5000 to 8000 kPa.

9. The process of claim 1, wherein a weighted average bed temperature for hydrotreating the COD product using a cobalt-molybdenum catalyst does not exceed 321° C., wherein the liquid hourly space velocity is maintained at 0.6, and wherein a hydrogen to hydrocarbon ratio is 275.

* * * * *